US006394075B2

(12) United States Patent
Castaldini

(10) Patent No.: US 6,394,075 B2
(45) Date of Patent: May 28, 2002

(54) DEVICE FOR TREATING FUEL IN INTERNAL COMBUSTION ENGINES

(75) Inventor: Davide Castaldini, Venturina (IT)

(73) Assignee: Maria del Mar Busca Rey, Piacenza (IT)

( * ) Notice: Subject to any disclaimer, the term of this patent is extended or adjusted under 35 U.S.C. 154(b) by 0 days.

(21) Appl. No.: 09/863,220

(22) Filed: May 23, 2001

Related U.S. Application Data

(63) Continuation of application No. PCT/ES99/00373, filed on Nov. 22, 1999.

(30) Foreign Application Priority Data

Nov. 24, 1998 (ES) ..... 9802462

(51) Int. Cl.[7] ..... F02M 27/04

(52) U.S. Cl. ..... 123/536; 123/538

(58) Field of Search ..... 123/536, 537, 123/538; 210/222, 695

(56) References Cited

U.S. PATENT DOCUMENTS

| | | | | | |
|---|---|---|---|---|---|
| 4,372,852 | A | | 2/1983 | Kovacs | 210/222 |
| 4,568,901 | A | * | 2/1986 | Adam | 210/222 |
| 4,995,425 | A | | 2/1991 | Weisenbarger et al. | 137/827 |
| 5,129,382 | A | * | 7/1992 | Stamps, Sr. et al. | 123/536 |
| 5,320,751 | A | * | 6/1994 | Burns | 210/222 |
| 5,520,158 | A | * | 5/1996 | Williamson | 123/538 |
| 5,664,546 | A | * | 9/1997 | De La Torre Barreiro | 123/538 |
| 5,943,998 | A | * | 8/1999 | Brown et al. | 123/538 |

FOREIGN PATENT DOCUMENTS

| | | | |
|---|---|---|---|
| ES | ES 1026427 | 4/1994 | A63B/29/02 |
| WO | WO 95/04000 | 2/1995 | C02F/1/48 |

* cited by examiner

*Primary Examiner*—Marguerite McMahon
(74) *Attorney, Agent, or Firm*—Darby & Darby

(57) ABSTRACT

A device for treating fuel in internal combustion engines. The device comprises, within a surrounding body which is insulating in relation to magnetic field, a through-pipe for supplying the fuel to the engine and a plurality of magnetic masses which create a magnetic field perpendicular to the direction of movement of the fuel inside its through-pipe.

3 Claims, 4 Drawing Sheets

DEVICE FOR TREATING FUEL IN INTERNAL COMBUSTION ENGINES

This is a continuation of international application Ser. No. PCT/ES99/00373, filed Nov. 22, 1999, the entire disclosure of which is hereby incorporated by reference.

FIELD OF THE INVENTION

The present invention is intended to disclose a method of treating fuel upon its admittance to internal combustion engines, in order to improve various characteristics of their performance.

BACKGROUND OF THE INVENTION

The device of the present invention has been designed on the basis of investigations carried out by the inventor in order to reduce environmental pollution caused by internal combustion engines and to improve their performance, with the aim of reducing consumption.

OBJECT OF THE INVENTION

In particular, the application of the present invention is intended to facilitate compliance with the new standards of the European Economic Community relating to pollution.

The device of the present invention acts by modifying the chemical-physical properties of the molecules of the fluids (petrol, gas oil and mixtures), ensuring a more uniform mixture between the atoms of the fluid and atmospheric oxygen, giving rise to optimal combustion.

SUMMARY OF THE INVENTION

Although the inventor does not wish to be limited by any specific theory, according to his investigations, he has established a theory regarding the functioning of the present invention, according to which the electrons around the central nucleus of each atom create a weak magnetic field; for this reason, all of the chemical elements and the molecules are surrounded by this weak magnetic field, which is nevertheless sufficient to induce attraction forces in the intermolecular spaces, and are grouped in a disorderly manner. Complete reaction between the fuel and the oxygen in the cylinders is thus hindered, since contact between the oxygen and the carbon and hydrogen atoms of the fuel is prevented.

The basis of the present invention consists in causing the fluid, as it flows through the interior of the device, to be surrounded by a strong magnetic field which favours weakening of the mutual magnetic attraction of the molecules and breakage of the weak magnetic connection, destroying the molecules and transforming them into atoms. When the fuel has passed through the device, the atoms are separated from one another, following an orderly course, permitting improved diffusion of the oxygen, improving combustion, and reducing the emission of CO in favour of $CO_2$, reducing the formation of NOx, as well as the emission of residues and the deposition of carbonaceous substances. In short, a notable reduction in consumption, a cleaner engine, and a considerable reduction in polluting emissions are achieved.

The device of the present invention is intended to be located along the path of the fuel to be treated, obliging the fuel to pass through the strong magnetic field, which is created inside the device in a direction perpendicular to the direction of movement of the fuel. The improvement of the mixture between the oxygen and the fuel atoms favours the combustion process, leading to a series of advantages, amongst which the following stand out:

the emission of residues is notably reduced, fuel consumption is reduced, the engine has increased power but is quieter, the life of the catalyst is doubled, the engine starts immediately even at low temperatures, it is an effective solution for protecting the environment and urban life.

To achieve its objects, the device of the present invention comprises, basically, a cylindrical assembly carrying two or more magnetic masses in the form of elongate bars between which the fuel pipe extends towards the engine, the assembly being surrounded by a first tubular element which is particularly appropriate in the preferred case in which the body supporting the polar masses is formed by two elongate elements coupled with one another in a manner such that both together complete an enveloping cylindrical shape, the elements being coupled along a flat surface or along stepped surfaces, and having housings for receiving the magnetic masses. An outer surrounding body and guide for the fuel pipe is preferably composed of two elements in the form of long cylindrical cups which face one another, forming a cylindrical body closed at its ends by end portions having holes through which the fuel pipe can extend. An outer protective and insulating envelope is constituted principally by a synthetic resin envelope fixed to the ends of the surrounding body.

U.S. Pat. No. 4,995,425 discloses a magnetic fluid conditioner with magnetic masses applied onto right angle laminar parts which surround a central conduit for the fluid. The invention is applicable in the household to prevent the incrustation of calcium salts and in the industry on conduits transmitting crude oil. However, said document does not disclose nor suggest the use of a carrying body with cavitites to receive the magnetic masses combined with multiple surrounding bodies for the treatment of fuel in internal combustion engines.

BRIEF DESCRIPTION OF THE DRAWINGS

For a better understanding, some drawings of a preferred embodiment of the device of the present invention are appended by way of non-limiting example.

DETAILED DESCRIPTION OF THE INVENTION

Figure 1:
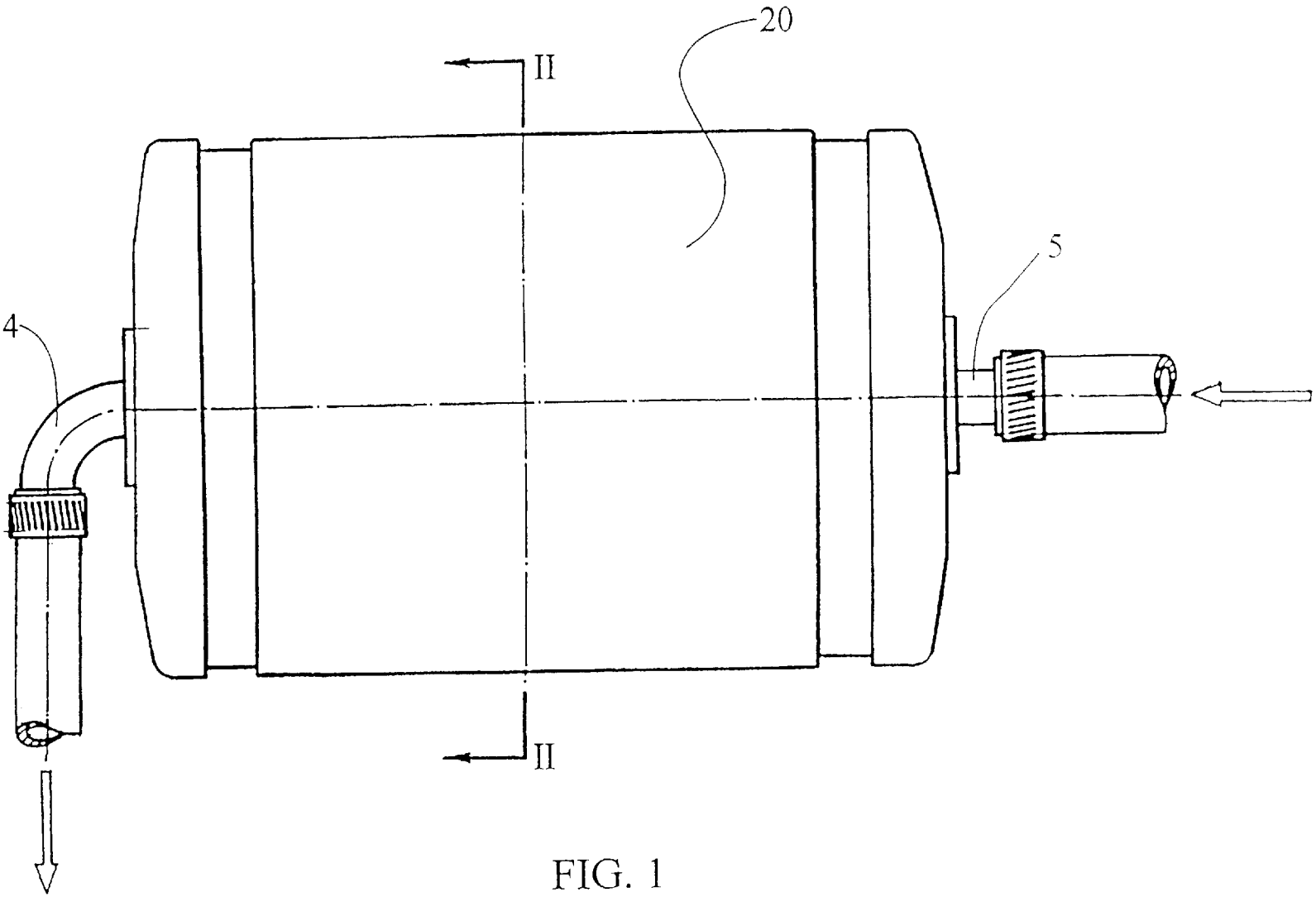
FIG. 1 is an external plan view of the device.
Figure 2:
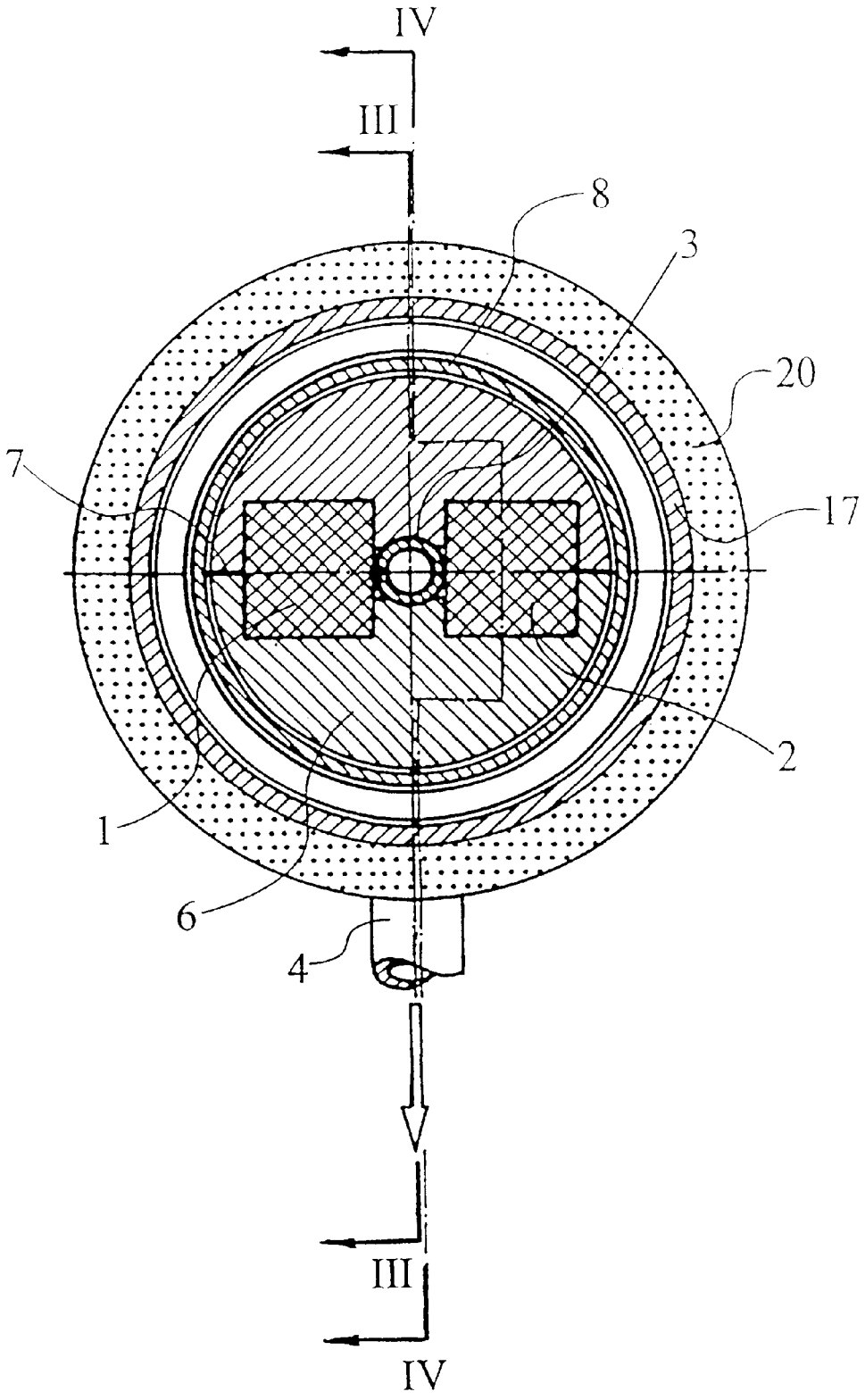
FIG. 2 is a cross-section of the device.
Figure 3:
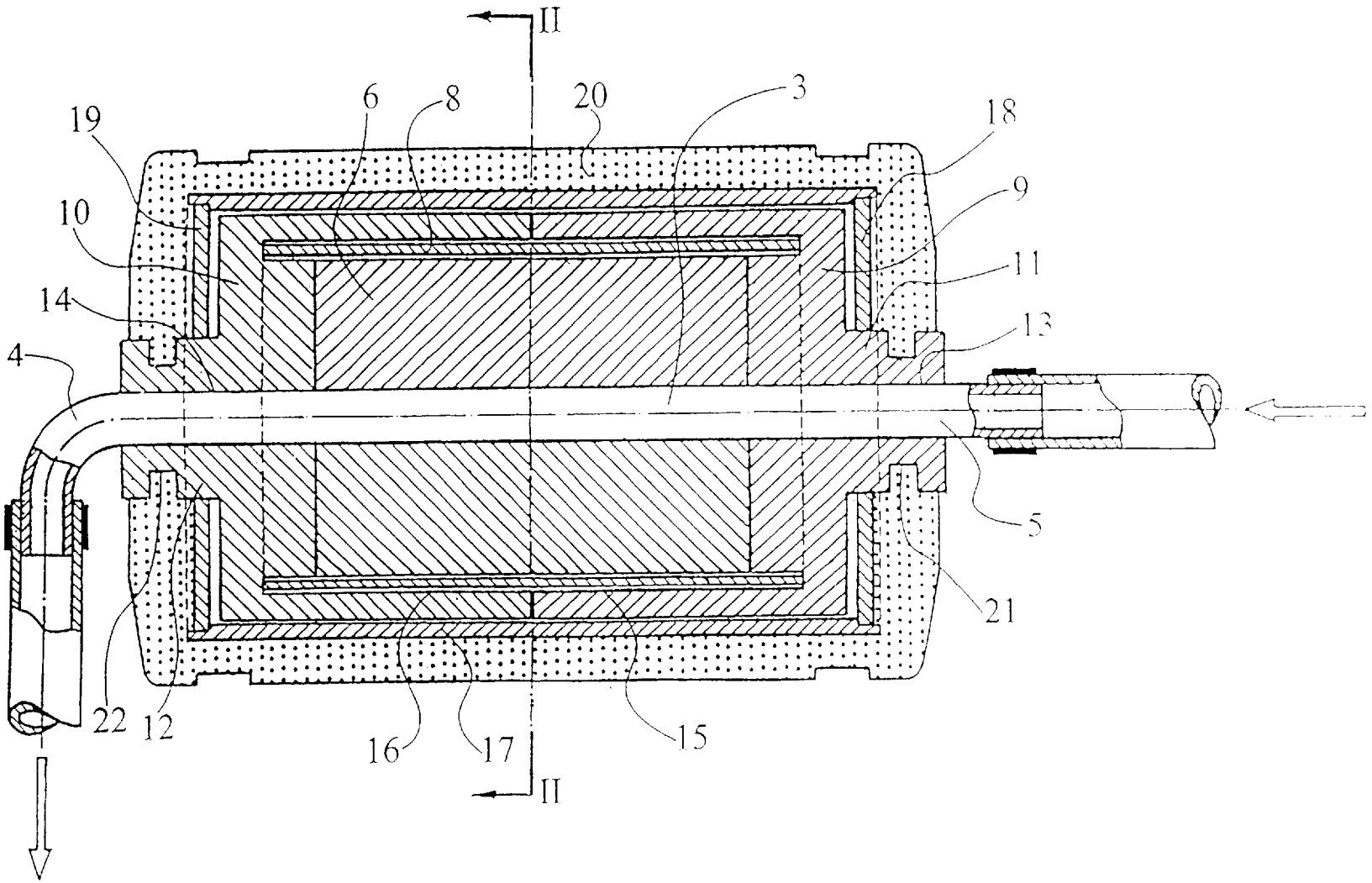
FIG. 3 is a longitudinal section through a device, showing the pipe which extends longitudinally through it.
Figure 4:
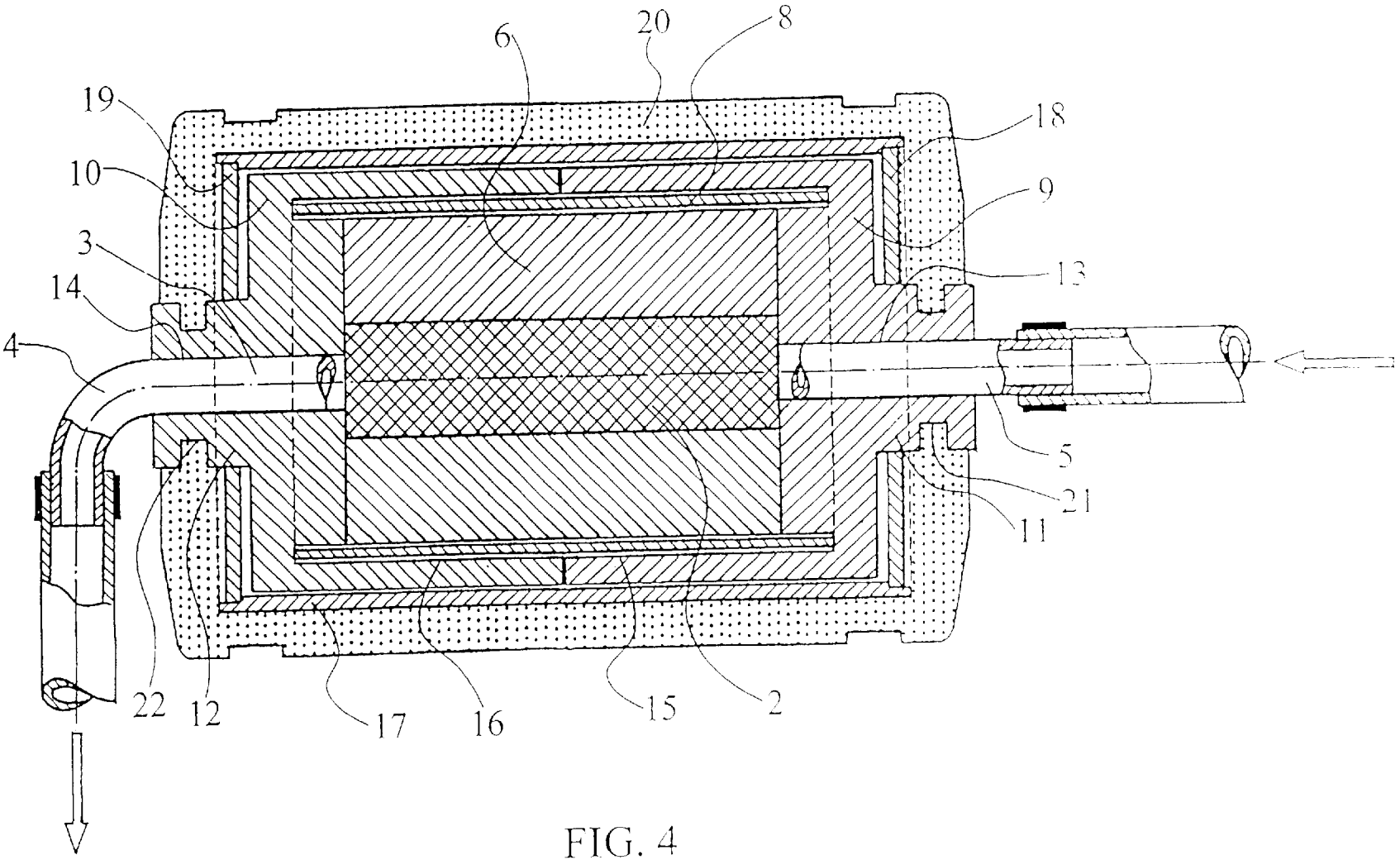
FIG. 4 is a longitudinal section which includes one of the magnetic masses.

As can be seen from the drawings, the device of the present invention comprises two or more elongate, high-remanence magnetic masses 1 and 2 disposed adjacent a fuel-supply pipe 3 which extends towards the engine, for example, via an outlet pipe 4, having entered through the other end of the device, via a pipe 5, FIG. 1. The magnetic masses are enclosed in a carrying body 6 which surrounds them completely and which may be constituted, for example, by two elements facing one another along the median plane 7 of the body. The shape of the carrying body 6, as well as that of the magnetic masses 1 and 2, may vary, since it is not essential for the operation of the device. Thus, for example, instead of having the cylindrical shape shown, it may have a right-angled parallelepipedal shape, a prismatic shape, etc.

A retaining body 8 surrounds the body 6 carrying the magnetic masses and in turn is housed in an assembly constituted by two symmetrical elements 9 and 10 which are in the form of elongate, cylindrical cups with respective end portions in which stumps 11 and 12 are formed, the stumps 11 and 12 having through-holes 13 and 14 through which the fuel pipe 3 can extend. The said elements 9 and 10 face one another and house the ends of the surrounding body 8, having annular guide grooves 15 and 16 for receiving the ends of the surrounding body 8.

Arranged over the assembly formed by two bodies 9 and 10 is a further cylindrical surrounding body 17 in which caps 18 and 19 are fitted, the whole being included inside an envelope of insulating synthetic resin 20 which is introduced into grooves 21 and 22 of the stumps 11 and 12 to improve anchorage.

The construction provided for produces a device which is very effective, owing to its magnetic action on the fuel flowing towards the engine, and which also has characteristics of great rigidity and good insulation, as well as good mechanical and electrical characteristics, effectively insulating the magnetic field created.

Amongst the many variations which may be introduced into the device of the present invention are also those relating to the specific structure of the magnets surrounding the fuel pipe, since what is important is to create a transverse magnetic field relative to the flow of fuel, variations being possible in the number of polar masses, of which two have been shown by way of example but of which there could be a larger number, as well as in their specific form, which may be as continuous bars or fragmented bars, etc.

What is claimed is:

1. A device for treating fuel in internal combustion engines which comprises within a surrounding body a through-pipe for supplying the fuel to the engine and a plurality of magnetic masses which create a magnetic field perpendicular to the direction of movement of the fuel inside its through-pipe, in which the body carrying the magnetic masses is formed by two parts capable of attachment one to the other, wherein said parts determine lengthwise cavities for receiving the magnetic masses and passages for receiving the pipe for the fuel, which is arranged between said parts with its central axis parallel to the longitudinal axis of the magnetic masses, and having:

(a) a first cylindrical body surrounding said parts carrying the magnetic masses);

(b) a second surrounding body formed by two cylindrical cups with closing end portions incorporated to permit the passage of the conduit for the fuel;

(c) an overall surrounding body of cylindrical form closed by means of end covers engaged on the internal cups; and (d) an outer cover of insulating synthetic resin.

2. A device for treating fuel in internal combustion engines according to claim 1, wherein the cylindrical cups forming the second surrounding body extend in end stumps having passageways for the fuel pipe, externally receiving the covers of the surrounding cylindrical body and having external grooves for the attachment of the outer cover of insulating synthetic resin.

3. A device for treating fuel in internal combustion engines according to claim 1, wherein the outer cover of insulating synthetic resin surrounds all of the external cylindrical surface and the end covers of the device engaging the grooves of the end stumps of the cups which form the second surrounding body.

* * * * *